US010887721B2

(12) United States Patent
Pedersen et al.

(10) Patent No.: US 10,887,721 B2
(45) Date of Patent: Jan. 5, 2021

(54) COMMUNICATION DEVICE WITH SPATIAL SOURCE SEPARATION, COMMUNICATION SYSTEM, AND RELATED METHOD

(71) Applicant: GN HEARING A/S, Ballerup (DK)

(72) Inventors: Søren Christian Pedersen, Ballerup (DK); Casper Silbo Raft, Ballerup (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/435,460

(22) Filed: Jun. 7, 2019

(65) Prior Publication Data

US 2019/0387354 A1 Dec. 19, 2019

(30) Foreign Application Priority Data

Jun. 18, 2018 (EP) ..... 18178280

(51) Int. Cl.

| | |
|---|---|
| ***H04S 7/00*** | (2006.01) |
| ***H04R 3/04*** | (2006.01) |
| ***H04R 5/033*** | (2006.01) |
| ***H04R 5/04*** | (2006.01) |

(52) U.S. Cl.

CPC ..... *H04S 7/307* (2013.01); *H04R 3/04* (2013.01); *H04R 5/033* (2013.01); *H04R 5/04* (2013.01); *H04S 7/306* (2013.01); *H04S 2420/01* (2013.01)

(58) Field of Classification Search

None

See application file for complete search history.

(56) References Cited

U.S. PATENT DOCUMENTS 6,011,851 A 1/2000 Connor et al.
6,175,631 B1 * 1/2001 Davis ..... H04R 5/04 381/17

OTHER PUBLICATIONS

Extended European Search Report dated Nov. 29, 2018 for corresponding European Application No. 18178280.6.

Habigt, Tim et al. "Enhancing 3D Audio Using Blind Bandwidth Extension" Nov. 2010, AES 129th Convention, San Francisco, CA.

* cited by examiner

*Primary Examiner* — Kenny H Truong

(74) *Attorney, Agent, or Firm* — Vista IP Law Group, LLP

(57) ABSTRACT

A communication system, a communication device and related method, the communication device comprising a processor, a source interface comprising a first source interface for a first external source, and an output interface, wherein the processor is configured to obtain, e.g. receive, a first input signal via the first source interface, obtain a first complementing signal, combine the first input signal and the first complementing signal to a first combined signal, apply a first filter function to the first combined signal for provision of a first left output signal and a first right output signal, the first filter function comprising one or more head related transfer functions, and output a left output signal and a right output signal via the output interface, wherein the left output signal is based on the first left output signal and the right output signal is based on the first right output signal.

22 Claims, 5 Drawing Sheets

COMMUNICATION DEVICE WITH SPATIAL SOURCE SEPARATION, COMMUNICATION SYSTEM, AND RELATED METHOD

RELATED APPLICATION DATA

This application claims priority to, and the benefit of, European Patent Application No. 18178280.6 filed on Jun. 18, 2018. The entire disclosure of the above application is expressly incorporated by reference herein.

FIELD

The present disclosure relates to a communication device, a communication system comprising a communication device and related methods including a method of operating a communication device. In particular, the present disclosure relates to a communication device with spatial source separation and/or spatial source positioning

BACKGROUND

When communicating electronically via multi-talker communication system, audio signals from different sources or channels are electronically mixed together into a single signal that is presented over headphones. When using such systems to communicate with a group of persons, listeners are not able to take advantage of binaural cues resulting from the different spatial positions of the persons, and have to rely on cues like voice or content.

It may be desirable for a listener to be able to distinguish the different sources while communicating via multi-talker communication systems.

SUMMARY

Accordingly, there is a need for communication devices, communication systems and methods which allows the user to separate between sources of different audio signals.

A communication device is disclosed, the communication device comprising a processor, a source interface comprising a first source interface for a first external source, and an output interface, wherein the processor is configured to obtain, e.g. receive, a first input signal via the first source interface; obtain a first complementing signal; combine the first input signal and the first complementing signal to a first combined signal; apply a first filter function to the first combined signal for provision of a first left output signal and a first right output signal, the first filter function comprising one or more head related transfer functions; and output a left output signal and a right output signal via the output interface, wherein the left output signal is based on the first left output signal and/or the right output signal is based on the first right output signal.

Also disclosed is a communication system comprising a communication device as described herein, the communication system comprising a left speaker and a right speaker for connection to the output interface of the communication device.

Further, a method of operating a communication device is disclosed, the communication device comprising a processor, a source interface, and an output interface, the method comprising obtaining a first input signal from a first external source via the source interface; obtaining, e.g. providing or generating, a first complementing signal; combining the first input signal and the first complementing signal to a first combined signal; applying a first filter function to the first combined signal for provision of a first left output signal and a first right output signal, the first filter function comprising one or more head related transfer functions; and outputting a left output signal and a right output signal via the output interface, wherein the left output signal is based on the first left output signal and the right output signal is based on the first right output signal.

The present disclosure allows the user to separate between sources of different audio signals by combining them with complementing signals and adding binaural cues, the complementing signals allowing more detailed binaural cues to be added.

It is an important advantage of the present disclosure that directionality of input signal(s) is improved, e.g. in turn providing a more effective spatial separation of sources in multi-source communication devices.

A communication device includes: a processor; a source interface comprising a first source interface for a first external source; and an output interface; wherein the processor is configured to: obtain a first input signal via the first source interface; obtain a first complementing signal; combine the first input signal and the first complementing signal to obtain a first combined signal; apply a first filter function to the first combined signal for provision of a first left output signal and a first right output signal; and output a left output and a right output via the output interface, wherein the left output is based on the first left output signal, and wherein the right output is based on the first right output signal.

Optionally, the processor is configured to apply the first filter function to the first combined signal by: applying a first left filter to the first combined signal for provision of the first left output signal, wherein the first left filter comprises a first left head-related transfer function; and applying a first right filter to the first combined signal for provision of the first right output signal, wherein the first right filter comprises a first right head-related transfer function.

Optionally, the source interface comprises a second source interface for a second external source; and wherein the processor is configured to: obtain a second input signal via the second source interface; obtain a second complementing signal; combine the second input signal and the second complementing signal to obtain a second combined signal; and apply a second filter function to the second combined signal for provision of a second left output signal and a second right output signal; wherein the left output is also based on the second left output signal, and the right output is also based on the second right output signal.

Optionally, the processor is configured to apply the second filter function to the second combined signal by: applying a left filter to the second combined signal for provision of the second left output signal, wherein the left filter comprises a left head-related transfer function; and applying a right filter to the second combined signal for provision of the second right output signal, wherein the right filter comprises a right head-related transfer function.

Optionally, the processor is configured to apply the first filter function to the first combined signal by: (1) applying a first left filter to the first combined signal for provision of the first left output signal, wherein the first left filter comprises a first left head-related transfer function, and (2) applying a first right filter to the first combined signal for provision of the first right output signal, wherein the first right filter comprises a first right head-related transfer function; and wherein the processor is configured to apply the second filter function to the second combined signal by: (1) applying a second left filter to the second combined signal for provision of the second left output signal, wherein the second left filter comprises a second left head-related transfer function, and (2) applying a second right filter to the second combined signal for provision of the second right output signal, wherein the second right filter comprises a second right head-related transfer function.

Optionally, the processor comprises an input signal shaping module configured to attenuate frequencies of the first input signal that are larger than a first low-pass frequency.

Optionally, the communication device comprising a signal generation module for generating one or more noise signals and/or signal(s) having tone(s).

Optionally, the processor comprises a signal shaping module configured to attenuate frequencies of the one or more noise signals and/or the signal(s) having tone(s) from the signal generation module that are smaller than a first high-pass frequency.

Optionally, the first filter function comprises one or more head related transfer functions.

A communication system includes the communication device, the communication device comprising a left speaker and a right speaker coupled to the output interface of the communication device.

A method performed by a communication device comprising a processor, a source interface, and an output interface, includes: obtaining a first input signal from a first external source via the source interface; obtaining a first complementing signal; combining the first input signal and the first complementing signal to obtain a first combined signal; applying a first filter function to the first combined signal for provision of a first left output signal and a first right output signal; and outputting a left output and a right output via the output interface, wherein the left output is based on the first left output signal, and wherein the right output is based on the first right output signal.

Optionally, the act of applying the first filter function to the first combined signal comprises: applying a first left filter to the first combined signal for provision of the first left output signal, wherein the first left filter comprises a first left head-related transfer function; and applying a first right filter to the first combined signal for provision of the first right output signal, wherein the first right filter comprises a first right head-related transfer function.

Optionally, the method further includes: obtaining a second input signal from a second external source via the source interface; providing a second complementing signal; combining the second input signal and the second complementing signal to obtain a second combined signal; and applying a second filter function to the second combined signal for provision of a second left output signal and a second right output signal; wherein the left output is also based on the second left output signal, and the right output is also based on the second right output signal.

Optionally, the act of applying the second filter function to the second combined signal comprises: applying a left filter to the second combined signal for provision of the second left output signal, wherein the left filter comprises a left head-related transfer function; and applying a right filter to the second combined signal for provision of the second right output signal, wherein the right filter comprises a right head-related transfer function.

Optionally, the method further comprises processing the first input signal to attenuate frequencies larger than a first low-pass frequency.

Optionally, the first complementing signal has a distribution of signal power as a function of frequency with a first percentage of the signal power lying above a first threshold frequency.

Optionally, the first complementing signal has a power distribution as a function of frequency, the first filter function has a gain distribution as a function of frequency, and wherein, for frequencies in a range between a first high-pass frequency and an upper threshold frequency, the power distribution of the first complementing signal overlaps the gain distribution of the first filter function.

Optionally, the act of obtaining the first complementing signal comprises generating noise signal(s) and/or signal(s) having tone(s).

Optionally, the act of obtaining the first complementing signal comprises processing the generated noise signal(s) and/or the signal(s) having tone(s) to attenuate frequencies smaller than a first high-pass frequency.

Optionally, the first filter function comprises one or more head related transfer functions.

Other features and advantageous will be described in the detailed description.

BRIEF DESCRIPTION OF THE DRAWINGS

The above and other features and advantages of the present disclosure will become readily apparent to those skilled in the art by the following detailed description of exemplary embodiments thereof with reference to the attached drawings, in which.

DETAILED DESCRIPTION

Figure 1:
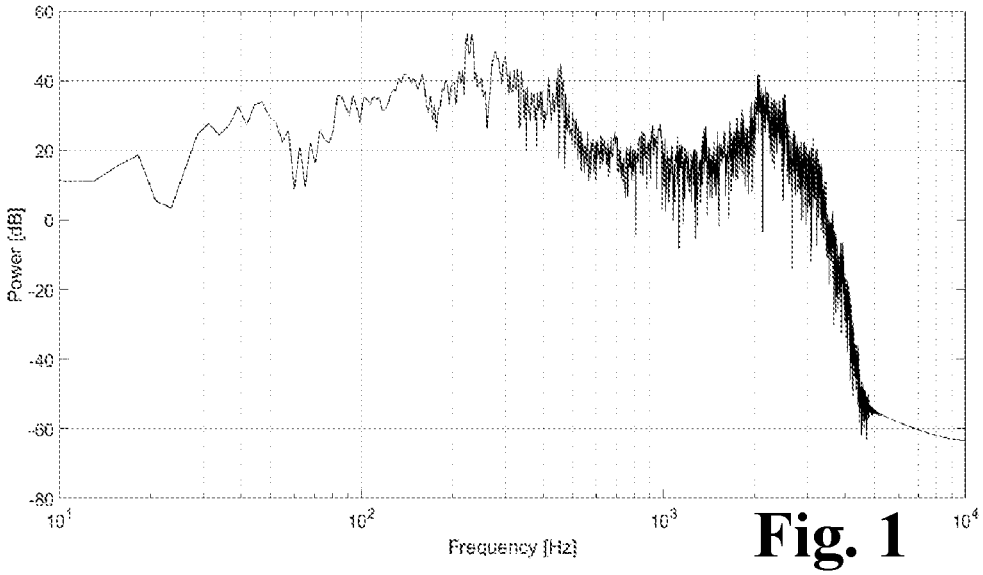
FIG. 1 is a graph illustrating a typical power spectrum for speech over a radio channel.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure described herein relates to a communication device comprising a processor configured to combine an input signal from an external source such as a radio with a complementing signal, and applying a filter function comprising a head-related transfer function for provision of a left and a right output signal. The filter function is applied to add directional information to the input signal so that it will appear to come from a specific direction. Signals on radios and similar devices are often limited in bandwidth, and human speech on a radio channel will typically be cut off a threshold frequency, e.g. around 3-4 kHz. Head-related transfer functions and similar filter functions often contain important information (directional cues in the form of attenuation dips or peaks) at frequencies higher than such threshold frequency. This information will be lost if the filter function is applied to a limited bandwidth signal mentioned above. This is problematic since the input signal may then not appear to come from any specific direction or since different signals may appear to come from similar directions. By combining the incoming signal with the complementing signal, the effective bandwidth may be extended so that applying the filter function to the combined signal will render a reduced or no loss of information.

When referring to signals or audio signals in the present disclosure, electric or electromagnetic signals encoded with auditory content is generally meant. When referring to a power spectrum in the present disclosure, a time-averaged power spectrum of the auditory content of a signal is generally meant. The amplitude of a power spectrum of speech will vary strongly as a function of time, the frequency range it covers and its shape will typically vary less. In the present disclosure, it is the overall range and shape that is of interest.

The processor is configured to apply a first filter function to the first combined signal for provision of a first left output signal and/or a first right output signal. To apply a first filter function to the first combined signal may comprise applying a first left filter to the first combined signal for provision of the first left output signal. The first left filter may be a first left head-related transfer function (HRTF_1_L). To apply a first filter function to the first combined signal may comprise applying a first right filter to the first combined signal for provision of the first right output signal. The first right filter may be a first right head-related transfer function (HRTF_1_R). Thus, the present communication device is able to effectively control the perceived direction from which the first input signal originates.

In the communication device, the source interface may comprise a second source interface for a second external source, such as a second radio or a connection to a second radio channel. The processor may be configured to obtain or receive a second input signal via the second source interface; obtain a second complementing signal; combine the second input signal and the second complementing signal to a second combined signal; apply a second filter function to the second combined signal for provision of a second left output signal and/or a second right output signal; the second filter function optionally comprising one or more head related transfer functions, wherein the left output signal is based on the second left output signal and/or the right output signal is based on the second right output signal. Accordingly, the left output signal may be based on both the first left output signal and the second left output signal. The left output signal may be a sum or weighted sum of left output signals from the filter functions. Accordingly, the right output signal may be based on both the first right output signal and the second right output signal. The right output signal may be a sum or weighted sum of right output signals from the filter functions.

To apply a second filter function to the first combined signal may comprise applying a second left filter to the second combined signal for provision of the second left output signal. The second left filter may be a second left head-related transfer function (HRTF_2_L). To apply a second filter function to the first combined signal may comprise applying a second right filter to the second combined signal for provision of the second right output signal. The second secondary filter may be a second right head-related transfer function (HRTF_2_R). Thus, the present communication device provides effective and improved separation first input signal and the second input signal.

When a first input signal is obtained or received, the left output signal and the right output signal are based on the first left output signal and the first right output signal, and when a second input signal is obtained/received, the left output signal and the right output signal are based on the second left output signal and the second right output signal. When a first input signal and a second input signal are obtained/received in parallel, the left and right output signals may be based on both the first left and right output signals and the second left and right output signals. In one or more exemplary communication devices, the processor is optionally configured to base the left and right output signals on a selected one of the first and second input signals, for example the input signal that started earlier or has a highest priority.

The first filter function and the second filter function may be different, e.g. so that the first and second input signals will appear or be perceived as originating from different spatial positions or directions. Thus, the first left filter and the second left filter may be different and the first right filter and the second right filter may be different, as are the related HRTF's. In other words, the first filter function may be different from the second filter function such that a first input signal is perceived to come from a first direction and the second input signal is perceived to come from a second direction different from the first direction. The first left filter may be different from the second left filter. The first right filter may different from the second right filter.

It is possible to position a source based on monaural cues, i.e. using only one ear, the positioning typically being limited to up/down and front/back, whereas the left/right position information is usually lost. To apply the first filter function to the first combined signal may comprise applying only one head related transfer function for provision of identical first left and right output. In this case, the first source will appear to originate from a position in a front/back-above/below-plane (corresponding to $\varphi=0$ in FIG. 1). This may be advantageous if the user accidentally switches left and right speakers or uses only one speaker. To apply the second filter function to the second combined signal may comprise applying only one head related transfer function for provision of identical second left and right output signals. In this case, the second source will appear to originate from a position in a front/back-above/below-plane (corresponding to $\varphi=0$ in FIG. 1). This may be advantageous if the user accidentally switches left and right speakers or uses only one speaker.

The communication device may comprise a memory for storing the various filter functions and filters to be retrieved by the processor upon application of these.

In one or more exemplary communication systems, the processor is configured to receive/obtain N input signals, where N is an integer, e.g. in a range from 2 to 25, such as 2, 3, 4, 5, 6, 7, 8, 16, 20; obtain N complementing signals; and combine the N input signals and the N complementing signals to N combined signals. The processor may be configured to apply a respective filter function to each of the N combined signals for provision of N left output signals and N right output signals, each of the filter functions comprising one or more head related transfer functions; and output a left output signal and a right output signal via the output interface, wherein the left output signal is based on, such as a sum of, the N left output signals from and/or the right output signal is based on, such as a sum of, the N right output signal. The left output signal may be a sum of N left output signals, the N left output signals respectively based on the N input signals. The right output signal may be a sum of N right output signals, the N right output signals respectively based on the N input signals.

The processor of the communication device may comprise an input signal shaping module configured to attenuate frequencies of the first input signal that are larger than a first low-pass frequency. For example, the input signal shaping module may comprise a first input filter for pre-processing or otherwise shaping the first input signal. This serves to cut off parts of the first input signal that contains little or no information or have fluctuating power. Such parts of the first input signal are preferably removed and compensated for by the first complementing signal that can have sufficient and predictable power in this range. The first low-pass frequency may be in the range from 3 kHz to −4 kHz. The input signal shaping module may be configured to attenuate frequencies of the second input signal that are larger than a second low-pass frequency. For example, the input signal shaping module may comprise a second input filter for pre-processing or otherwise shaping the second input signal. This serves to cut off parts of the second input signal that contains little or no information or have fluctuating power. Such parts of the second input signal are preferably removed and compensated for by the second complementing signal that can have sufficient and predictable power in this range. The second low-pass frequency may be in the range from 3 kHz to −4 kHz.

The communication device, such as the processor, may comprise a signal generation module for generating one or more noise signals and/or signals consisting of different tones. Signals from the signal generator may be used directly as complementing signals by the processor, or they may be shaped or otherwise processed by the processor to form the complementing signals. The first complementing signal may be the same as or different from the second complementing signal. The use of different complementing signals for different input signals and/or different filter functions allows for a further improved directionality of the input signals as perceived by the user and/or reduced complexity of filter functions. The signal generation module may be integrated in the processor or form a separate unit in the communication device.

The processor of the communication device may comprise a secondary signal shaping module configured to process signals from the signal generation module for forming the complementing signal(s). The secondary signal shaping module may be configured to attenuate frequencies of one or more signals from the signal generation module that are smaller than a first high-pass frequency. For example, the secondary signal shaping module may comprise a secondary first filter for shaping, e.g. high-pass filtering, a first noise signal from the signal generation module to provide the first complementing signal. The secondary first filter may be a high-pass filter with a first high-pass frequency. The first high-pass frequency may be larger than 1 kHz, such as in the range from 2 kHz to −5 kHz. In one or more exemplary communication devices, the first high-pass frequency is in the range from 3-4 kHz. For example, the secondary signal shaping module may comprise a secondary second filter for shaping, e.g. high-pass filtering, a second noise signal from the signal generation module to provide the second complementing signal. The secondary second filter may be a high-pass filter with a second high-pass frequency. The second high-pass frequency may be larger than 1 kHz, such as in the range from 2 kHz to −5 kHz. In one or more exemplary communication devices, the second high-pass frequency is in the range from 3-4 kHz.

This may serve to shape the complementing signal(s) to match where the corresponding (shaped) input signal(s) has little or no power. The power spectra of the complementing signal(s) and corresponding input signal may overlap or there may be a range with no or low power between them. Preferably, the power spectrum of the complementing signal is matched to that of the (optionally shaped) input signal, so that the corresponding combined signal will not have large peaks or dips in the transition region between the input signal and the complementing signal.

A communication system is disclosed, the communication system comprising a communication device as described herein and a left receiver and a right receiver for connection to the output interface of the communication device. A receiver, such as the left receiver and/or the right receiver, forms or provides an audio signal based on an output signal. The output signal for the receiver may be a combination of one or more output signals, such as a combination or sum of a first left or right output signal and a second left or right output signal. The left receiver and a right receiver are preferably headphones, preferably earpieces or in-ear headphones.

The present disclosure relates to a method of operating a communication device. In the method, applying a first filter function to the first combined signal may comprise applying a first left filter to the first combined signal for provision of the first left output signal. The first left filter may be a first left head-related transfer function (HRTF_1_L). Applying a first filter function to the first combined signal may comprise applying a first right filter to the first combined signal for provision of the first right output signal. The first right filter may be a first right head-related transfer function (HRTF_1_R).

The method of operating a communication device may comprise obtaining a second input signal from a second external source via the source interface, obtaining, e.g. providing or generating, a second complementing signal, combining the second input signal and the second complementing signal to a second combined signal, applying a second filter function to the second combined signal for provision of a second left output signal and/or a second right output signal; the second filter function optionally comprising one or more head related transfer functions, and wherein the left output signal is based on the second left output signal and/or the right output signal is based on the second right output signal. Accordingly, the left output signal may be based on both the first left output signal and the second left output signal. The left output signal may be a sum or weighted sum of left output signals from the filter functions. Accordingly, the right output signal may be based on both the first right output signal and the second right output signal. The right output signal may be a sum or weighted sum of right output signals from the filter functions.

Applying a second filter function to the second combined signal may comprise applying a second left filter to the second combined signal for provision of the second left output signal. The second left filter may be a second left head-related transfer function (HRTF_2_L). Applying a second filter function to the second combined signal may comprise applying a second right filter to the second combined signal for provision of the second right output signal. The second right filter may be a second right head-related transfer function (HRTF_2_R).

The method of operating a communication device may comprise processing the first input signal to attenuate frequencies larger than a first low-pass frequency.

Obtaining complementing signal(s), such as the first complementing signal and/or the second complementing signal, may comprise generating one or more noise signals and/or a signal consisting of different tones. For example, providing the first complementing signal may comprise generating a noise signal or a signal consisting of different tones. Obtaining the first complementing signal may comprise processing, e.g. filtering, the generated signal, e.g. to attenuate frequencies smaller than a first high-pass frequency. The first high-pass frequency may be larger than 1 kHz, such as in the range from 2 kHz to −5 kHz. In one or more exemplary communication devices, the first high-pass frequency is in the range from 3-4 kHz.

Obtaining the second complementing signal may comprise processing, e.g. filtering, the generated signal, e.g. to attenuate frequencies smaller than a second high-pass frequency. The second high-pass frequency may be larger than 1 kHz, such as in the range from 2 kHz to −5 kHz. In one or more exemplary communication devices, the second high-pass frequency is in the range from 3-4 kHz. A common complementing signal may be used at both the first complementing signal and the second complementing signal.

Obtaining the first complementing signal may comprise providing a first complementing signal having a distribution of signal power as a function of frequency with a first percentage of the signal power lying above a first threshold frequency. The first percentage may be at least 70%, preferably 80% or preferably 90%. The first threshold frequency may be in the range 3-4 kHz. This serves to ensure that the first complementing signal has little or no power in the range that may overlap with the first input signal. Obtaining the second complementing signal may comprise providing a second complementing signal having a distribution of signal power as a function of frequency with a second percentage of the signal power lying above a second threshold frequency. The second percentage may be at least 70%, preferably 80% or preferably 90%. The second threshold frequency may be in the range 3-4 kHz. This serves to ensure that the second complementing signal has little or no power in the range that may overlap with the second input signal.

The method of operating a communication device wherein the first complementing signal has a distribution of signal power as a function of frequency and the first filter function has a distribution of attenuation as a function of frequency, and wherein, for frequencies in a range between a first high-pass frequency and an upper threshold frequency, the power distribution of the first complementing signal overlaps the attenuation distributions of the first filter function. The person skilled in the art knows that a filter function can only have an effect if the signal to be filtered has power at the frequencies that are attenuated by the filter function. If neither the first input signal nor the first complementing signal has substantial power in a frequency range where the first filter function has significant peak or dip, the information in this peak or dip will not be passed on to the first left and right output signals. The range between a first high-pass frequency and an upper threshold frequency is preferably a range from a frequency in which the first input signal has little or no power to a frequency where the human can no longer hear the output signal, where the first filter function does no longer hold spatial information cues, or where the combined signal bandwidth limits the signal. The first high-pass frequency is preferably in the range from 2 kHz to 5 kHz and the upper threshold frequency is preferably in the range 10-15 kHz, or even higher. The upper threshold frequency may be given by the Nyquist frequency, i.e. half the sampling frequency.

Accordingly, the first complementing signal may have distribution of signal power as a function of frequency, and the first filter function has a distribution of gain as a function of frequency. For frequencies in a range between a first high-pass frequency and an upper threshold frequency, the power distribution of the first complementing signal may overlap the gain distribution of the first filter function.

The method or at least parts thereof may be performed by a communication device or a communication system as disclosed herein.

Figure 2:
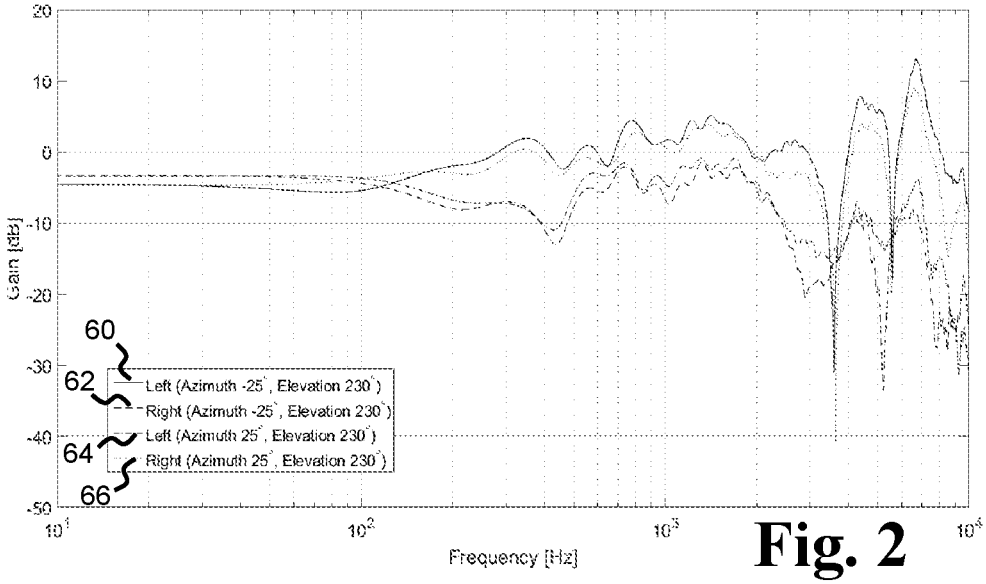
FIG. 2 is a graph illustrating four typical gain spectra for HRTFs corresponding to different directions.
Figure 3:
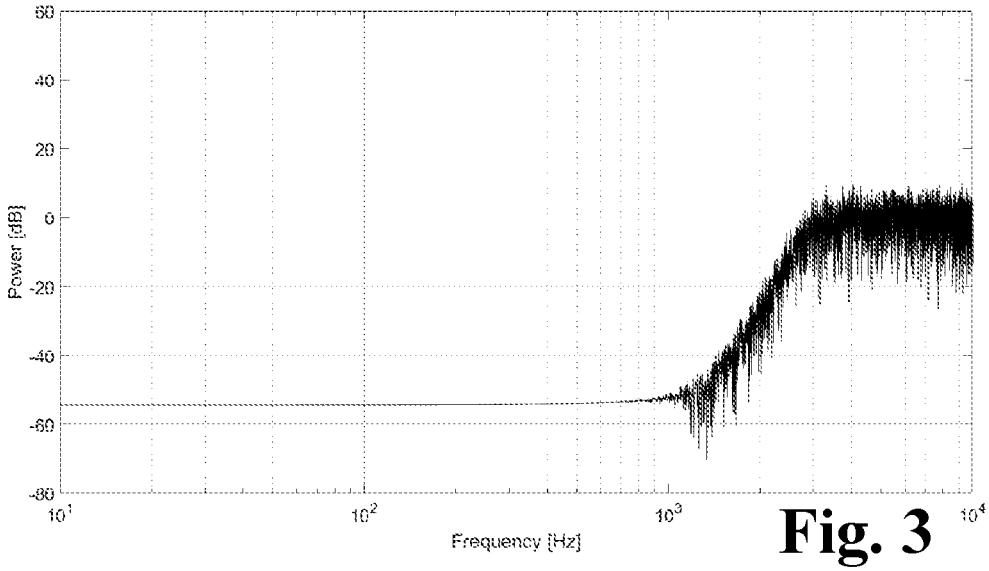
FIG. 3 is a graph illustrating a power spectrum for an exemplary complementing signal according to the disclosure.

FIG. 1 and FIG. 3 are graphs illustrating respective examples of the input signal and complementing signals of the disclosure. FIG. 2 is a graph illustrating a gain spectrum of exemplary head-related transfer functions.

The first and second input signals are signals encoded with auditory content, typically speech. A time-averaged speech spectrum (talking over e.g. one minute) typically covers the range 100 Hz-5 kHz, with most energy in the lower (<1 kHz) frequency bands corresponding to vowel sounds and less energy in the higher-frequency bands (1-5 kHz) corresponding to consonant sounds. In addition, higher harmonics up to 15 kHz can be produced.

The bandwidth allocated for a single voice-frequency transmission channel, e.g. on a radio, is usually limited so that frequencies above 3.5 kHz are cut off. This is to save bandwidth and since the higher harmonics are not required for understanding speech content and distinguishing voices. FIG. 1 is a graph illustrating a typical power spectrum for speech over a radio channel, i.e. a power spectrum of an exemplary first and/or second input signal. As can be seen, the power spectrum starts falling of around 3 kHz.

A head-related transfer functions (HRTF), also referred to as an anatomical transfer function, shows how a human ear receives sound from a given point in space. As sound strikes the listener, several factors including the size and shape of the head, ears, ear canal, density of the head, size and shape of nasal and oral cavities, transform the sound and affect how the sound is perceived, giving rise to a transfer function being a gain spectrum with frequencies having both positive and negative gain. HRTFs are person-specific so that HRTFs corresponding to sound originating from the same direction will differ for different persons. Still, a generalized or average HRTF corresponding to sound originating from direction A will, when applied to an acoustic signal, result in different listeners to hear the sounds as coming from the same general direction. Also, two HRTFs corresponding to sound originating from two different directions will, when applied to acoustic signals, result in different listeners to hear the sounds as coming from two different directions.

FIG. 2 is a graph illustrating typical gain spectra for left/right ear HRTFs corresponding to two different directions. The directions can be derived from FIG. 4. Thus:

curve 60 is the left ear HRTF corresponding to sound originating from a back-low-left direction curve 62 is the right ear HRTF corresponding to sound originating from a back-low-left direction curve 64 is the left ear HRTF corresponding to sound originating from a back-low-right direction curve 66 is the right ear HRTF corresponding to sound originating from a back-low-right direction.

It can be seen that the HRTFs contain substantial information in the range above 3-4 kHz. The information in the range>3 kHz comprises information relating to the vertical position of the source, and originates in the size, shape and vertical asymmetry of the earlobes. When a filter based on a HRTF function is applied to a first or second input signal like in FIG. 5, the information above 3-4 kHz is lost since this signal has no power in this range—in other words, there is no signal onto which this information can be encoded. Thus, applying different HRTF-based filters to different voice-frequency transmission channels (and channels with similar bandwidth limit) will place the apparent directions of origin in different horizontal (azimuthal) directions only, most information relating to vertical directionality (elevation or altitude) will be lost. This is a disadvantage since valuable information used to further distinguish different channels is lost.

The communication device, system, and related method according to the present disclosure provide a first complementing signal to be combined with the first input signal and allowing information of the filter function that cannot be encoded onto the first input signal to be encoded onto the combined signal. FIG. 3 is a graph illustrating a power spectrum for an exemplary first complementing signal according to the disclosure. Here, the power of the complementing signal rises in the range (3-4 kHz) where the power of the input signal in FIG. 1 drops off. Thereby, the resulting combined signal will have sufficient power over the range 80 Hz-10 kHz so that all information in the HRTF of FIG. 2 can be encoded thereon. This is advantageous since this will allow the combined signals to have apparent directions of origin in both horizontal (azimuthal) and vertical (elevation or altitude) directions.

Figure 4:
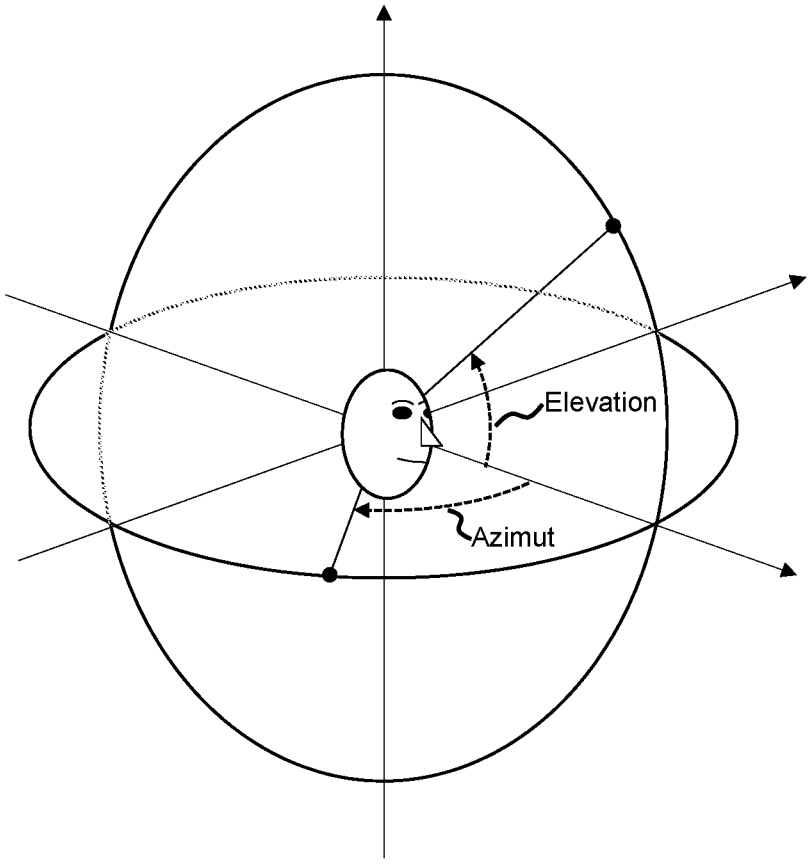
FIG. 4 is an illustration of a head and a spherical coordinate system centered in the head, FIG. 5 schematically illustrates an exemplary communication system according to the present disclosure.

FIG. 4 shows a horizontal or spherical coordinate system with a head at its center, used in this disclosure to specify (apparent or perceived) directions of origin of sounds.

Figure 5:
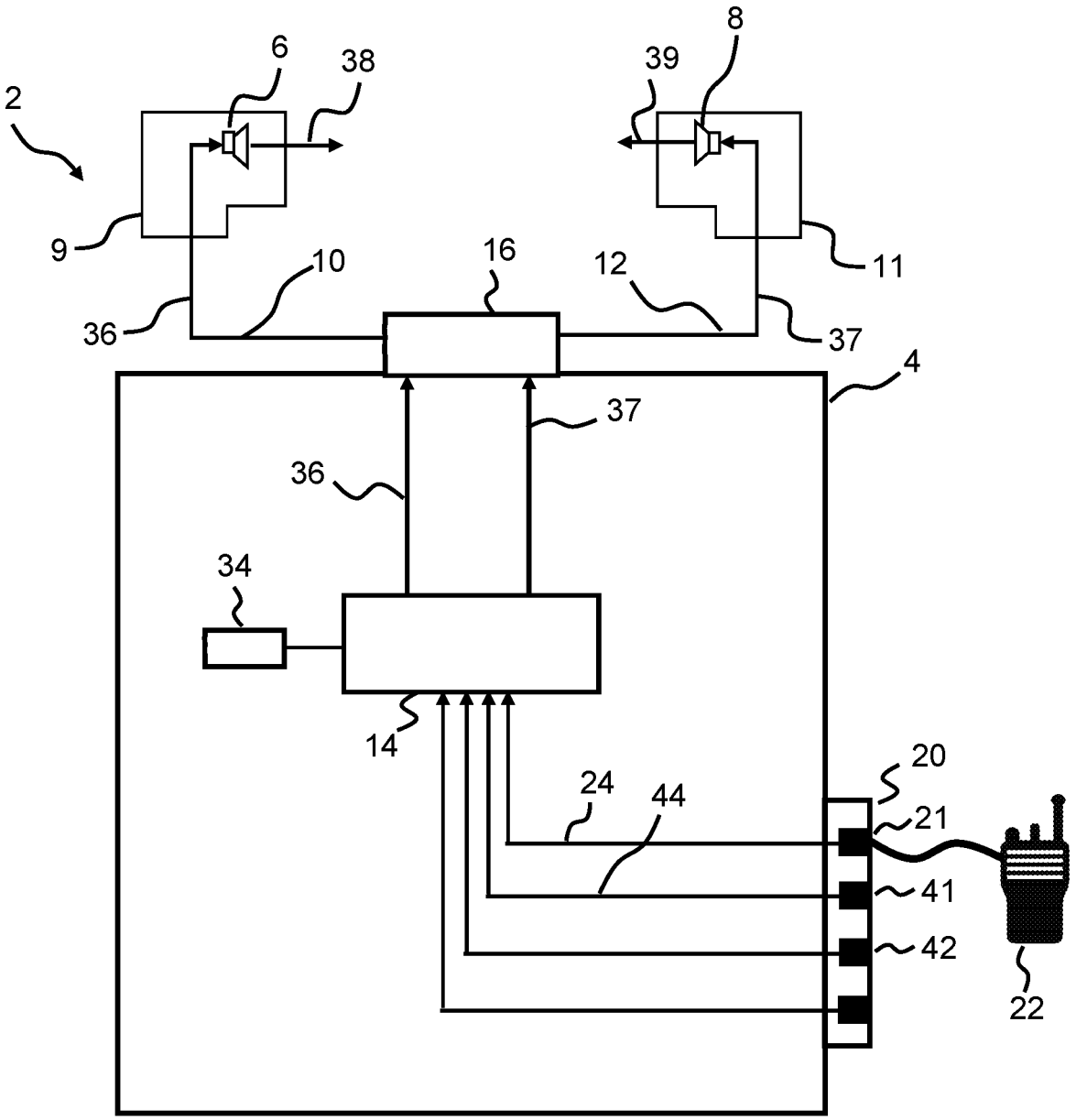

FIG. 5 shows an exemplary communication system. The communication system 2 comprises a communication device 4 and a left receiver 6 and a right receiver 8. The left receiver 6 can be part of a left earpiece 9 comprising a left connection 10, and the right receiver 8 can be part of a right earpiece 11 comprising a right connection 12. The connection 10 and 12 might be wired connections or wireless connections such as Bluetooth connections.

The communication device 4 comprises a processor 14 such as a central processing unit (CPU) or a digital signal processor (DSP), an output interface 16, a memory 18 and an source interface 20 comprising a first source interface 21, such as a socket or a wireless receiver, for a first external source 22 such as a radio, walkie talkie, telephone or another source that can provide a signal with auditory content.

The processor 14 is configured to obtain or receive a first input signal 24 from the first external source 22 via the first source interface 21, obtain a first complementing signal and combine these to a first combined signal. Further, the processor 14 is configured to apply a first filter function comprising one or more head-related transfer functions to the first combined signal for provision of a first left output signal and a first right output signal. The processor 14 outputs a left output signal 36 and a right output signal 37 via output interface 16. The first filter function and the one or more head-related transfer functions may be stored by a memory 34 also comprised by the communication device 4, and the processor 14 may be configured to retrieve such functions from the memory 34 when needed. The memory 34 may be integrated in the processor 14.

In the communication device 2, the left output signal 36 is based on the first left output signal, and the right output signal 37 is based on the first right output signal. The left and right output signals 36, 37 are then transmitted via the left and right connections 10, 12 to the left and right receivers 6, 8, respectively. The left receiver 6 forms left audio signal 38 for the left ear of the user based on left output signal 36, and the right receiver 8 forms right audio signal 39 for the right ear of the user.

Further, the processor 14 is optionally configured to obtain or receive a second input signal 44 from a second external source (not shown) via a second source interface 41, obtain a second complementing signal and combine the second input signal 44 and the second complementing signal to a second combined signal, apply a second filter function to the second combined signal for provision of a second left output signal and a second right output signal, and to base the left output signal 36 on the second left output signal and base the right output signal 37 on the second right output signal.

The communication device may comprise a third source interface 42, and further source interfaces for receiving input from further external devices, and the processor 4 may be configured to process these similar to the first and second input signals as described herein.

In one or more exemplary communication device, the first external source 22 such as a radio, walkie talkie, telephone or another source may be connected to both the first source interface 21 and the second source 41 to provide the first input signal 24 and the second input signal 44.

Figure 6:
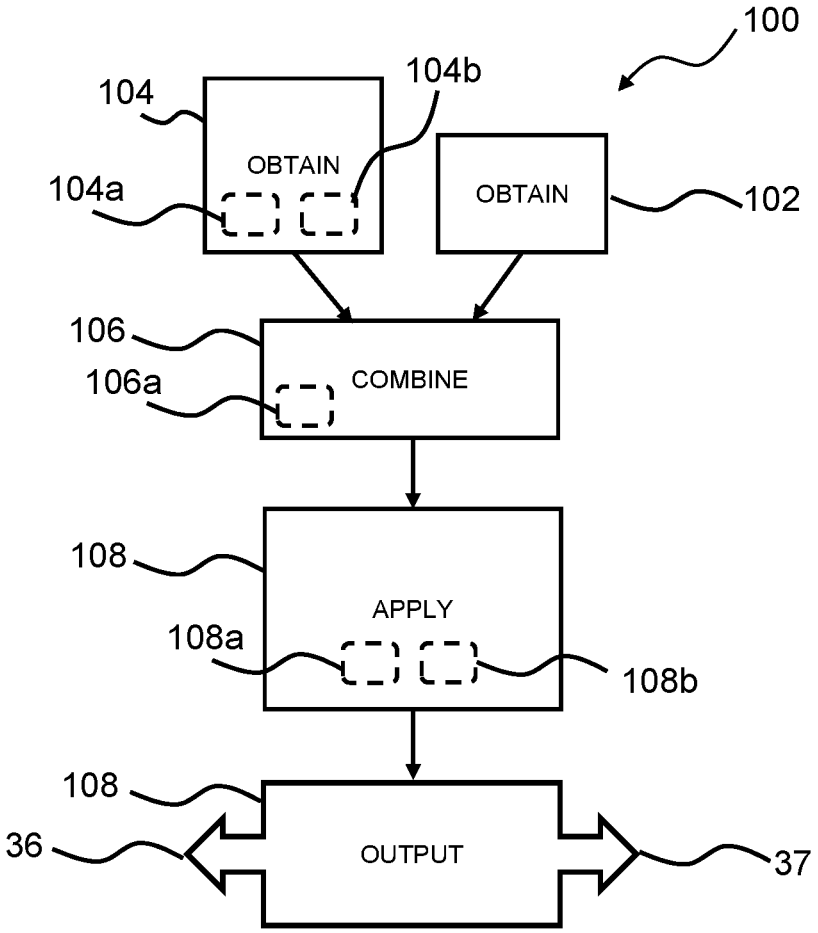
FIG. 6 is a flow diagram of an exemplary method according to the disclosure.

FIG. 6 is a flow diagram of an exemplary method of operating a communication device comprising a processor, a source interface, and an output interface. The method 100 comprises obtaining 102 a first input signal, such as a voice signal, from a first external source such as a radio via the source interface; obtaining 104 a first complementing signal, combining 106 the first input signal and the first complementing signal to a first combined signal, applying 108 a first filter function to the first combined signal for provision of a first left output signal and a first right output signal, and outputting 110 a left output signal and a right output signal via the output interface, wherein the left output signal is based on the first left output signal and the right output signal is based on the first right output signal.

Obtaining 104 the first complementing signal may comprise synthesizing, processing and/or shaping a signal for the first complementing signal to have a distribution of signal power as a function of frequency with a first percentage of the signal power lying above a first threshold frequency. The threshold frequency is preferably in the frequency range where the power of the first input signal drops off, and the first percentage is preferably at least 70, such as at least 80% or at least 90%. Having such power distribution is advantageous since the complementing signal thereby has little power in the range where the input signal contains information, meaning that it will not substantially disturb or add noise in this frequency range. An exemplary complementing signal can be seen in FIG. 3.

In the method 100, obtaining 104 the first complementing signal may comprise generating 104*a* a noise signal, e.g. with a signal generating module, and filtering or otherwise shaping 104*b* the noise signal, e.g. with a first filter, for provision of the first complementing signal. Filtering 104*b* the noise signal may comprise high-pass filtering the noise signal. Thus, obtaining 104 the first complementing signal may involve using a signal generation module for generating, selecting and/or mixing one or more noise signals and/or signals consisting of different tones as described in relation to FIG. 1. In addition, obtaining the first complementing signal may comprise shaping, filtering or otherwise processing a signal from the signal generating module to obtain a first complementing signal having the characteristics described herein.

In the method 100, combining 106 the first input signal and the first complementing signal to a first combined signal optionally comprises adding 106*a*, optionally in a weighted sum, the first input signal and the first complementing signal to form the first combined signal.

In the method 100, applying 108 a first filter function to the first combined signal comprises applying 108*a* a first left filter to the first combined signal for provision of the first left output signal, wherein the first left filter is a first left head-related transfer function; and applying 108*b* a first right filter to the first combined signal for provision of the first right output signal, wherein the first right filter is a first right head-related transfer function.

As also described in relation to FIG. 2 and FIG. 3, a power distribution of the first complementing signal preferably overlaps the gain distribution of the first filter function, at least for frequencies in a range between a first high-pass frequency (where the first input signal power drops) and an upper threshold frequency (e.g. upper bandwidth limit of combined signal). The term overlap is meant to describe that the first complementing signal has sufficient power at frequency bands where the first filter function gain has significant peaks or dips, so that the frequency bands of the combined signal onto which these peaks and dips have been encoded have a power sufficient for hearing and interpreting directional cues by the human ear.

Figure 7:
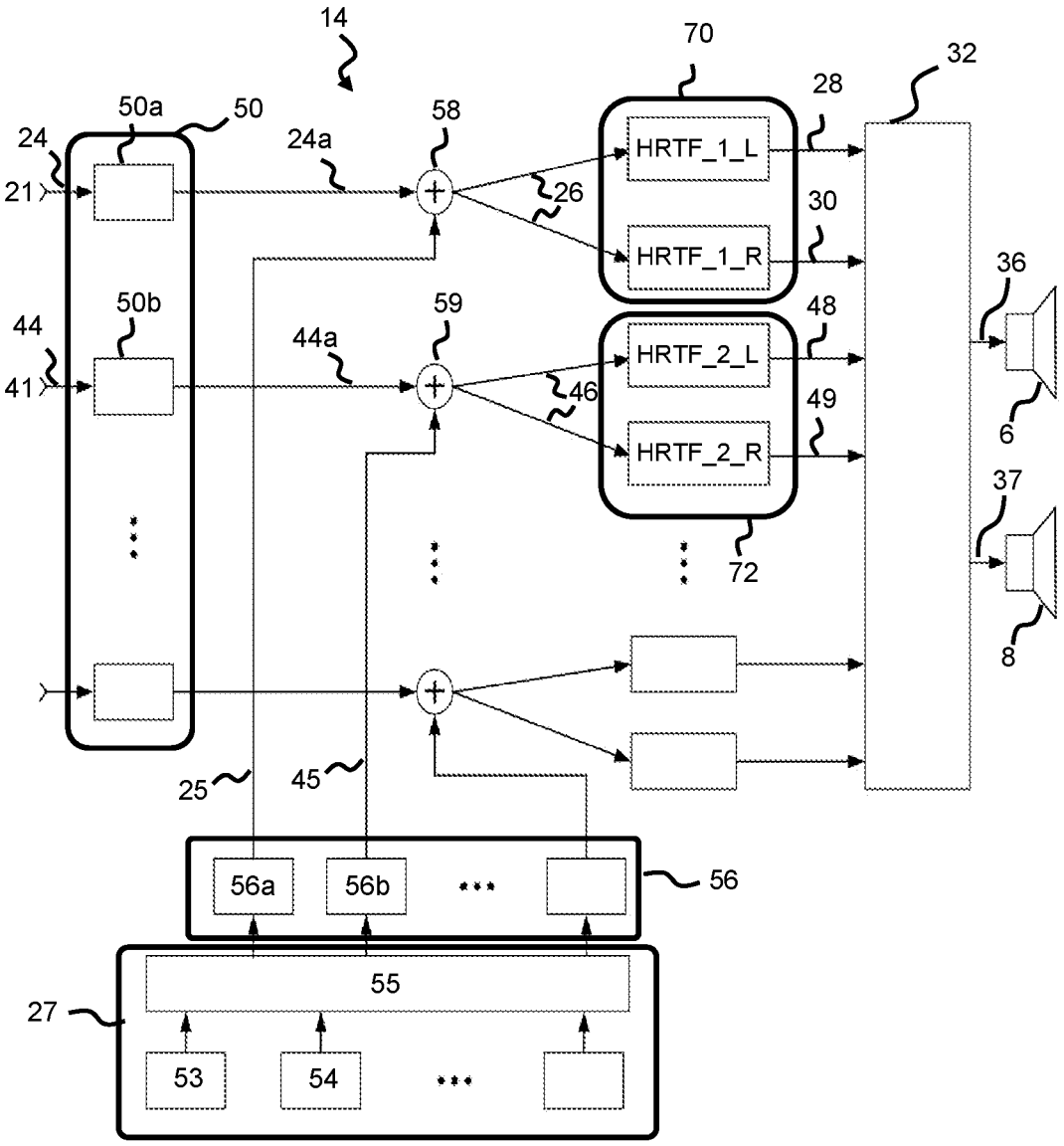
FIG. 7 is a block diagram of an exemplary processor of the communication device.

FIG. 7 is a schematic block diagram of selected elements of an exemplary communication device. First and second input signals 24, 44 are obtained/received at first and second source interfaces 21, 41. The processor 14 of the communication device may comprise input shaping module 50 used to filter, shape or otherwise process the respective input signals 24, 44 to provide processed first and second input signals 24*a*, 44*a*. The input shaping module 50 comprises first input filter 50*a* with a first low-pass frequency and configured to apply a low pass filter cutting off an upper tail of the input signals at a well-defined frequency to reduce overlap with the first complementing signal. The first low-pass frequency may be in the range from 3 kHz to −4 kHz. The input shaping module 50 optionally comprises second input filter 50*b* with a second low-pass frequency and configured to apply a low pass filter cutting off an upper tail of the input signals at a well-defined frequency to reduce overlap with the second complementing signal. The second low-pass frequency may be in the range from 3 kHz to −4 kHz.

The processor 14 may comprise a signal generating module 27 for generating signals used to obtain or provide the complementing signals. The signal generating module 27 may comprise at least a first noise generator 53 and/or at least a first tone generator 54, as well as a multiplexer 55 that can select and combine the generated signals to be used as a basis for the complementing signals. The signal generation module 27 may be configured to generate noise signals such as white noise, pink noise, or a synthesized signal comprising multiple tones and having a desired power vs. frequency spectrum. The signal generation module 27 may thus involve several signal generators and/or synthesizers as well as an input multiplexer and/or a mixer.

The processor 14 of the communication device may comprise secondary signal shaping module 56 including secondary first filter 56*a* and/or secondary second filter 56*b* used to filter, shape or otherwise process the signals from the signal generating module 27 to provide first complementing signal 25 and optionally second complementing signal 45. The secondary first filter 56*a* and the secondary second filter 56*b* may have respective first and second high-pass frequencies and each be configured to apply a high pass filter cutting off a lower part of the signals from the signal generating module 27 at well-defined frequencies to reduce overlap with the input signals. Each complementing signal 25, 45 may be provided with a power spectrum that provides a good overlap with the respective filter functions including specific HRTFs which will be applied to the corresponding combined signal. Different HRTF's may have significant peaks and dips in the range of the complementing signal, and since the HRTF to be applied to a given combined signal is known, the corresponding complementing signal may be designed accordingly.

The processor 14 is configured to combine the first processed input signal 24*a* (or first input signal 24 if no input signal shaping) with the first complementing signal 25 in a first adder 58 to provide the first combined signal 26. Other mixing of the first processed input signal 24*a* (or first input signal 24 if no input signal shaping) and the first complementing signal 25 is contemplated. Similarly, the processor 14 may combine the second processed input signal 44*a* (or second input signal 44 if no input signal shaping) with the second complementing signal 45 in a second adder 59 to provide the second combined signal 46. Other mixing of the second processed input signal 44*a* (or second input signal 44 if no input signal shaping) and the second complementing signal 45 is contemplated. The processor 14 is configured to apply a first filter function 70 to the first combined signal 26, wherein the first filter function 70 includes a first left head-related transfer function HRTF_1_L and/or a first right head-related transfer function HRTF_1_R to provide first left output signal 28 and first right output signal 30, respectively. The processor 14 is optionally configured to apply a second filter function 72 to the second combined signal 46, wherein the second filter function 72 includes a second left head-related transfer function HRTF_2_L and/or a second right head-related transfer function HRTF_2_R to provide second left output signal 48 and second right output signal 49, respectively.

The first left output signal 28 and the second left output signal 48 are combined, e.g. added and/or otherwise mixed, in mixer module 32 to form the left output signal 36. The first right output signal 30 and the second right output signal 49 are combined, e.g. added and/or otherwise mixed, in mixer module to form the right output signal 37. The left and right output signals 36, 37 are received by respective left and right receivers 6 and 8 to form corresponding left and right audio signals 38, 39.

Since the first left/right output signals 28, 30 and the second left/right output signals 48, 49 were provided by application of filter functions with different directional cues, auditory content of the first and second input signals 24, 44 will appear to originate from different directions to the user hearing the left and right audio signals 38, 39.

The above description describes the schematic block diagram of FIG. 7 with reference to a first input signal 24 and optionally a second input signal 44. The communication device may be configured to handle a larger number of input signals in parallel, such as 4 input signals, 6 input signals or 8 input signals, all input signals being complemented and processed to have different apparent directions of origin in order for the user to spatially separate the input signals using directional cues. Thus, communication device may comprise a larger number of source interfaces similar to the first and second source interfaces 21 and 41, as illustrated by the dots and further box in FIG. 7. In the same way, the communication device may comprise further input filters similar to input filters 50*a*, 50*b*, further noise generators similar to first noise generator 53, further tone generators similar to first tone generator 54, further secondary filters similar to secondary filters 56*a*, 56*b*, and/or further adders similar to adders 58, 59. It is also to be understood that one complementing signal may be used as both the first complementing signal and the second complementing signal.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering. Furthermore, the labelling of a first element does not imply the presence of a second element and vice versa.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 communication system
4 communication device
6 left receiver
8 right receiver
9 left earpiece
10 left connection
11 right earpiece
12 right connection
14 processor
16 output interface
18 memory
20 source interface
21 first source interface
22 first external source
24 first input signal
24*a* processed first input signal
25 first complementing signal
26 first combined signal
27 signal generating module
28 first left output signal
30 first right output signal
32 mixer module
34 memory
36 left output signal
37 right output signal
41 second source interface
42 third source interface
43 fourth source interface
44 second input signal
44*a* processed second input signal
45 second complementing signal
46 second combined signal
48 second left output signal
49 second right output signal
50 input shaping module
50*a* first input filter
50*b* second input filter
53 first noise generator
54 first tone generator
55 multiplexer
56 secondary signal shaping module
56*a* secondary first filter
56*b* secondary second filter
58 first adder
59 second adder
60 HRTF corresponding to front-low-left
62 HRTF corresponding to front-low-right
64 HRTF corresponding to front-up-left
66 HRTF corresponding to front-up-right
70 first filter function
72 second filter function
100 method of operating a communication device
102 obtaining a first input signal from a first external source
104 obtaining a first complementing signal
104*a* generating a noise signal
140*b* filtering the noise signal
106 combining the first input signal and the first complementing signal to a first combined signal
106*a* adding the first input signal and the first complementing signal
108 applying a first filter function to the first combined signal
108*a* applying first left head-related transfer function to the first combined signal for provision of the first left output signal
108*b* applying first right head-related transfer function to the first combined signal for provision of the first left output signal
110 outputting a left output signal and a right output signal via the output interface

The invention claimed is:

1. A communication device comprising:

a processor;

a source interface comprising a first source interface for communication with a first external source; and an output interface;

wherein the processor is configured to:

obtain a first input signal via the first source interface, the first input signal comprising speech information;

obtain a first complementing signal;

combine the first input signal and the first complementing signal to obtain a first combined signal;

apply a first filter function to the first combined signal for provision of a first left output signal and a first right output signal; and output a left output and a right output via the output interface, wherein the left output is based on the first left output signal, and wherein the right output is based on the first right output signal, wherein the left output and right output contain directionality cue for the first input signal that comprises the speech information;

wherein the first input signal comprising speech information has no directionality cue or less directionality cue compared to the directionality cue contained in the left and right outputs outputted by the processor.

2. The communication device according to claim 1, wherein the processor is configured to apply the first filter function to the first combined signal by:

applying a first left filter to the first combined signal for provision of the first left output signal, wherein the first left filter comprises a first left head-related transfer function; and applying a first right filter to the first combined signal for provision of the first right output signal, wherein the first right filter comprises a first right head-related transfer function.

3. The communication device according to claim 1, wherein the processor comprises an input signal shaping module configured to attenuate frequencies of the first input signal that are larger than a first low-pass frequency.

4. The communication device according to claim 1, the communication device comprising a signal generator for generating one or more noise signals and/or signal(s) having tone(s).

5. The communication device according to claim 4, wherein the processor comprises a signal shaping module configured to attenuate frequencies of the one or more noise signals and/or the signal(s) having tone(s) from the signal generator that are smaller than a first high-pass frequency.

6. The communication device according to claim 1, wherein the first filter function comprises one or more head related transfer functions.

7. A communication system comprising the communication device according to claim 1, the communication device comprising a left speaker and a right speaker coupled to the output interface of the communication device.

8. The communication device according to claim 1, wherein the processor is configured to output the left output to a left speaker, and to output the right output to a right speaker.

9. A communication device comprising:

a processor;

a source interface comprising a first source interface for a first external source; and an output interface;

wherein the processor is configured to:

obtain a first input signal via the first source interface;

obtain a first complementing signal;

combine the first input signal and the first complementing signal to obtain a first combined signal;

apply a first filter function to the first combined signal for provision of a first left output signal and a first right output signal; and output a left output and a right output via the output interface, wherein the left output is based on the first left output signal, and wherein the right output is based on the first right output signal;

wherein the source interface comprises a second source interface for a second external source; and wherein the processor is configured to:

obtain a second input signal via the second source interface;

obtain a second complementing signal;

combine the second input signal and the second complementing signal to obtain a second combined signal; and apply a second filter function to the second combined signal for provision of a second left output signal and a second right output signal;

wherein the left output is also based on the second left output signal, and the right output is also based on the second right output signal.

10. The communication device according to claim 9, wherein the processor is configured to apply the second filter function to the second combined signal by:

applying a left filter to the second combined signal for provision of the second left output signal, wherein the left filter comprises a left head-related transfer function; and applying a right filter to the second combined signal for provision of the second right output signal, wherein the right filter comprises a right head-related transfer function.

11. The communication device according to claim 9, wherein the processor is configured to apply the first filter function to the first combined signal by: (1) applying a first left filter to the first combined signal for provision of the first left output signal, wherein the first left filter comprises a first left head-related transfer function, and (2) applying a first right filter to the first combined signal for provision of the first right output signal, wherein the first right filter comprises a first right head-related transfer function; and wherein the processor is configured to apply the second filter function to the second combined signal by: (1) applying a second left filter to the second combined signal for provision of the second left output signal, wherein the second left filter comprises a second left head-related transfer function, and (2) applying a second right filter to the second combined signal for provision of the second right output signal, wherein the second right filter comprises a second right head-related transfer function.

12. A method performed by a communication device comprising a processor, a source interface, and an output interface, the method comprising:

obtaining a first input signal from a first external source via the source interface, the first input signal comprising speech information;

obtaining a first complementing signal;

combining the first input signal and the first complementing signal to obtain a first combined signal;

applying a first filter function to the first combined signal for provision of a first left output signal and a first right output signal; and outputting a left output and a right output via the output interface, wherein the left output is based on the first left output signal, and wherein the right output is based on the first right output signal, and wherein the left output and right output contain directionality cue for the first input signal that comprises the speech information;

wherein the first input signal comprising speech information has no directionality cue or less directionality cue compared to the directionality cue contained in the left and right outputs.

13. The method according to claim 12, wherein the act of applying the first filter function to the first combined signal comprises:

applying a first left filter to the first combined signal for provision of the first left output signal, wherein the first left filter comprises a first left head-related transfer function; and applying a first right filter to the first combined signal for provision of the first right output signal, wherein the first right filter comprises a first right head-related transfer function.

14. The method according to claim 12, further comprising processing the first input signal to attenuate frequencies larger than a first low-pass frequency.

15. The method according to claim 12, wherein the first complementing signal has a distribution of signal power as a function of frequency with a first percentage of the signal power lying above a first threshold frequency.

16. The method according to claim 12, wherein the act of obtaining the first complementing signal comprises generating noise signal(s) and/or signal(s) having tone(s).

17. The method according to claim 16, wherein the act of obtaining the first complementing signal comprises processing the generated noise signal(s) and/or the signal(s) having tone(s) to attenuate frequencies smaller than a first high-pass frequency.

18. The method according to claim 12, wherein the first filter function comprises one or more head related transfer functions.

19. The method according to claim 12, wherein the left output is outputted to a left speaker, and the right output is outputted to a right speaker.

20. A method performed by a communication device comprising a processor, a source interface, and an output interface, the method comprising:

obtaining a first input signal from a first external source via the source interface;

obtaining a first complementing signal;

combining the first input signal and the first complementing signal to obtain a first combined signal;

applying a first filter function to the first combined signal for provision of a first left output signal and a first right output signal; and outputting a left output and a right output via the output interface, wherein the left output is based on the first left output signal, and wherein the right output is based on the first right output signal;

wherein the method further comprises:

obtaining a second input signal from a second external source via the source interface;

providing a second complementing signal;

combining the second input signal and the second complementing signal to obtain a second combined signal; and applying a second filter function to the second combined signal for provision of a second left output signal and a second right output signal; and wherein the left output is also based on the second left output signal, and the right output is also based on the second right output signal.

21. The method according to claim 20, wherein the act of applying the second filter function to the second combined signal comprises:

applying a left filter to the second combined signal for provision of the second left output signal, wherein the left filter comprises a left head-related transfer function; and applying a right filter to the second combined signal for provision of the second right output signal, wherein the right filter comprises a right head-related transfer function.

22. A method performed by a communication device comprising a processor, a source interface, and an output interface, the method comprising:

obtaining a first input signal from a first external source via the source interface;

obtaining a first complementing signal;

combining the first input signal and the first complementing signal to obtain a first combined signal;

applying a first filter function to the first combined signal for provision of a first left output signal and a first right output signal; and outputting a left output and a right output via the output interface, wherein the left output is based on the first left output signal, and wherein the right output is based on the first right output signal;

wherein the first complementing signal has a power distribution as a function of frequency, the first filter function has a gain distribution as a function of frequency, and wherein, for frequencies in a range between a first high-pass frequency and an upper threshold frequency, the power distribution of the first complementing signal overlaps the gain distribution of the first filter function.

* * * * *